US007794139B2

(12) United States Patent
Barbier

(10) Patent No.: US 7,794,139 B2
(45) Date of Patent: Sep. 14, 2010

(54) WRISTWATCH WITH AN UNFOLDING CASE

(75) Inventor: Christophe Barbier, Bienne (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 11/851,213

(22) Filed: Sep. 6, 2007

(65) Prior Publication Data

US 2008/0062822 A1 Mar. 13, 2008

(30) Foreign Application Priority Data

Sep. 6, 2006 (EP) ..... 06018664

(51) Int. Cl.
*G04B 37/14* (2006.01)

(52) U.S. Cl. ..... 368/282

(58) Field of Classification Search ..... 368/280–282
See application file for complete search history.

(56) References Cited

U.S. PATENT DOCUMENTS

| | | | | |
|---|---|---|---|---|
| 601,982 | A * | 4/1898 | Peirson | 224/170 |
| 1,804,048 | A | 5/1931 | Bosch | |
| 2,926,825 | A * | 3/1960 | Wing | 224/164 |
| 4,681,462 | A * | 7/1987 | Lloyd | 368/69 |
| 5,239,521 | A * | 8/1993 | Blonder | 368/10 |
| 5,499,292 | A * | 3/1996 | Blonder et al. | 379/433.1 |
| 5,659,611 | A * | 8/1997 | Saksa | 379/433.1 |
| 5,779,113 | A * | 7/1998 | Huang | 224/172 |
| D438,483 | S * | 3/2001 | Mesica | D11/3 |
| 6,519,207 | B1 * | 2/2003 | Lukacsko | 368/10 |
| 6,991,364 | B2 * | 1/2006 | Yang | 368/281 |

FOREIGN PATENT DOCUMENTS

| | | |
|---|---|---|
| CH | 161610 | 7/1933 |
| CH | 320858 | 5/1957 |
| DE | 29613950 U1 | 12/1996 |
| DE | 20212658 U1 | 11/2002 |

OTHER PUBLICATIONS

European Search Report issued in corresponding application No. EP 06018664, completed Jun. 8, 2007.

* cited by examiner

*Primary Examiner*—Felix O Figueroa
(74) *Attorney, Agent, or Firm*—Griffin & Szipl, P.C.

(57) ABSTRACT

The wristwatch includes a case (3) carrying at least one watch movement and at least one display (7, 17) for the current time and for other time related or non-time related information. The case (3) is fixedly or rotatably mounted at the end of an additional strand (10), made in one or more parts (14, 16, 18), comprising locking/unlocking means (19, 29) allowing the watch to be unfolded inside the hand.

20 Claims, 8 Drawing Sheets

Fig. 11
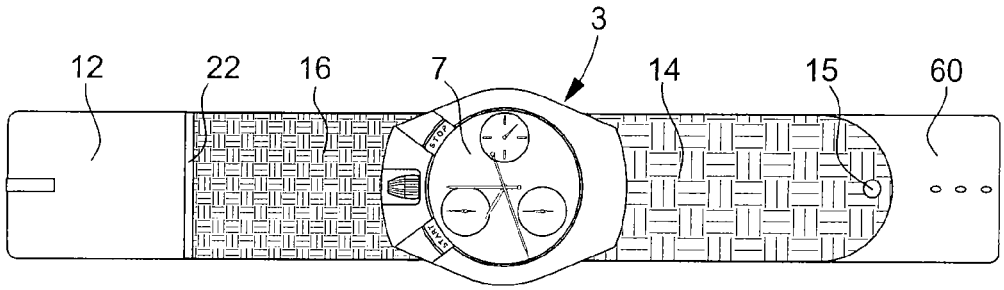
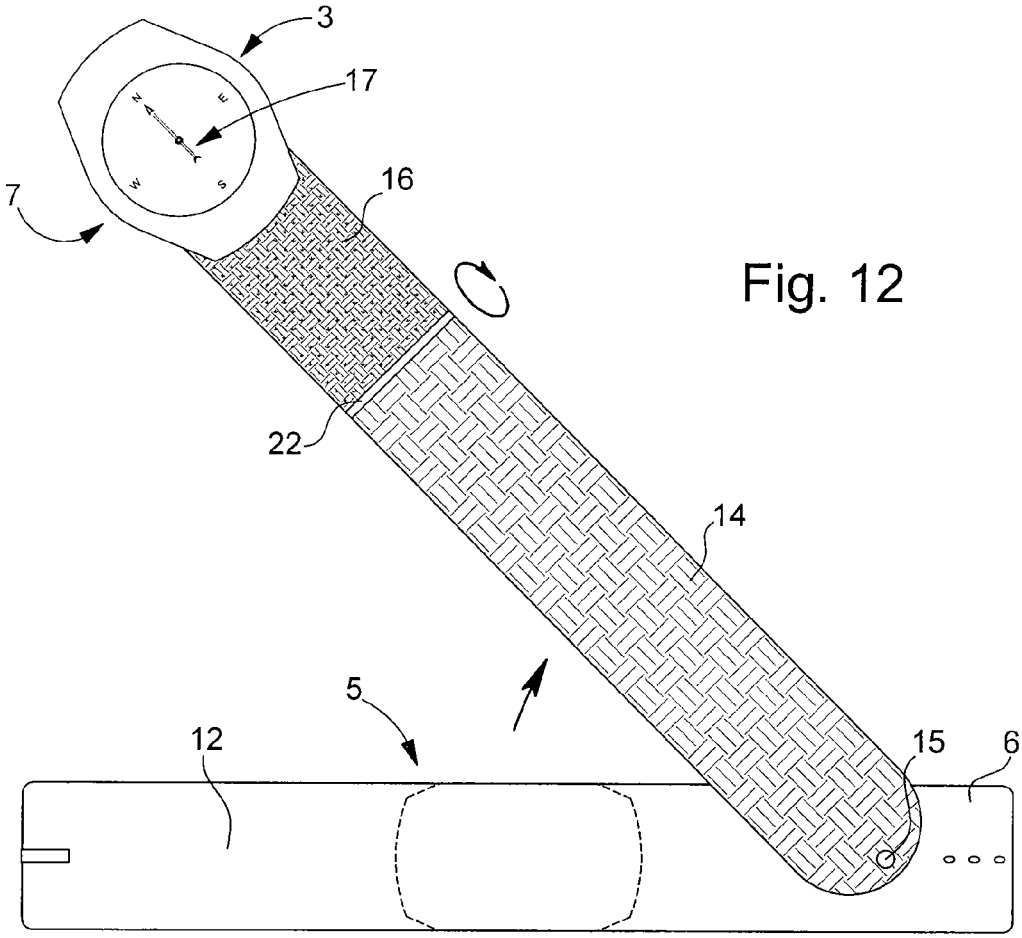
Fig. 12

WRISTWATCH WITH AN UNFOLDING CASE

FIELD OF THE INVENTION

This application claims priority from European Patent Application No. 06018664.0 filed Sep. 6, 2006, the entire disclosure of which is incorporated herein by reference.

The present invention concerns a wristwatch displaying the current time in a "normal" position and possibly a second piece of information, which may or may not be time related, the control and reading of which is facilitated by unfolding the case containing the control and display members, without necessarily detaching it from the wristband or bracelet, which is held on the wrist by a clasp.

BACKGROUND OF THE INVENTION

In the following description, a "normal position" display designates a display wherein the case is solidly connected to the wristband holding the wristwatch on the wrist and wherein the information displayed is read on the side of the back of the hand.

The case may occupy an entirely usual position by being permanently fixed to the wristband and thus have a display visible on the side of the back of the hand, while being substantially parallel to the latter. The case can also move away from this position slightly by tipping and/or pivoting in order to provide a better view of the display and/or to allow access to a second display located in the back cover of the case.

U.S. Pat. No. 1,804,048 discloses a device wherein the case swivels about a hinge when a push button passing through the middle part is pressed. In CH Patent No. 161 610, the device is formed of two hinged cases totally concealing a display oriented towards the back cover of the case connected to the wristband and making it the display visible when swivelled by at least 90°, when one wishes to access the information displayed.

In the "Tank basculante" model by Cartier, the case is pivotably mounted in a support, which is itself hinged via a hinge to a fixed case, which enables the mobile case to be turned over completely and provides access to a second display located in the back cover of the mobile case when the latter is returned to the normal position. In all of these devices of the prior art, the mobile case maintains a strong mechanical link with the wristband, and only allows the display to be read on the side of the back of the hand.

SUMMARY OF THE INVENTION

The present invention provides a new and innovative solution for reading information carried by a display that can be completely moved from its normal position, while maintaining a "safety" link with the wristband.

The invention therefore concerns a wristwatch with an unfolding case including a wristband or bracelet made in a single piece for totally encircling the wrist of the wearer, and closed by a clasp connecting the two wristband strands at 6 o'clock and at 12 o'clock. The wristband indirectly carries a case containing at least one watch movement for the display of time information and at least another piece of information which may or may not be time related. The invention is essentially characterized in that the case is mounted at the end of an additional flexible strand, the other end of which is pivotably fixed to one of the wristband strands. Via locking/unlocking means between the additional strand and the wristband, the case can occupy a normal position and a second position wherein it can be unfolded for positioning in the hand, i.e. for reading the display and manipulating the control members in an opposite position to the normal position.

The additional strand can be made in one part or in several parts, which will determine the position of the pivoting point on the wristband so that the display is oriented in the proper direction when the case is fixedly mounted on the additional strand and it is held in the hand. When the additional strand is in only one part, the pivoting point must be located on the 6 o'clock strand; when it is in two parts, connected to each other by a second pivoting point, it must be located on the 12 o'clock strand.

If the second alternative is selected for the pivoting point, the display will be reversed, a drawback that can be easily removed by rotatably mounting the case so that it can be turned over 180°.

When the additional strand is in two parts, a hinge can replace one pivoting point, with the exception of that located on the wristband. When the number of parts forming the additional strand is even, a pivoting pin must be provided along the length of said additional strand so that the case can be turned over when it is unfolded in the hand.

BRIEF DESCRIPTION OF THE DRAWINGS

Other advantages and features of the present invention will appear more clearly in the following description of various embodiments, given by way of non-limiting illustration, with reference to the annexed drawings, in which:

FIGS. 5 to 12 show top views of four other embodiments, with the wristband in the opened out flat position and, respectively, the normal position in the odd numbered Figures, and in the unfolded position in the even numbered Figures;

DETAILED DESCRIPTION OF THE INVENTION

The following embodiments are more specifically illustrated by an analogue display wristwatch whose case 3 contains a movement for, on the one hand display the current time on a display 7, and on the other hand for driving a chronograph mechanism controlled by push buttons 2*a* and 2*b*, arranged on either side of a crown 4, for displaying the timing information on the same display 7 as the current time.

It is clear that, without departing from the scope of the invention, display 7 could be of liquid crystal analogue type.

Figure 1:
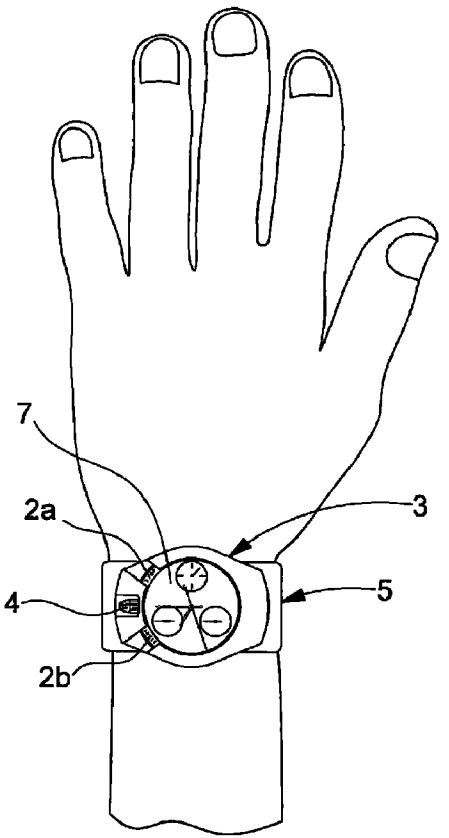
FIGS. 1 and 2 show a first embodiment of a wristwatch according to the invention, worn on the wrist in the normal position and in the flat, opened out position.
Figure 2:
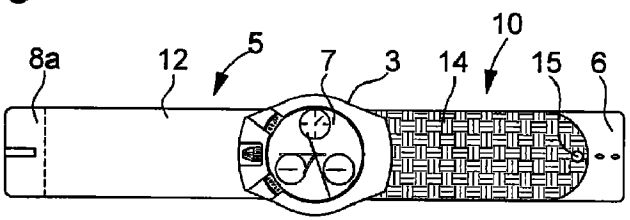
Figure 3:
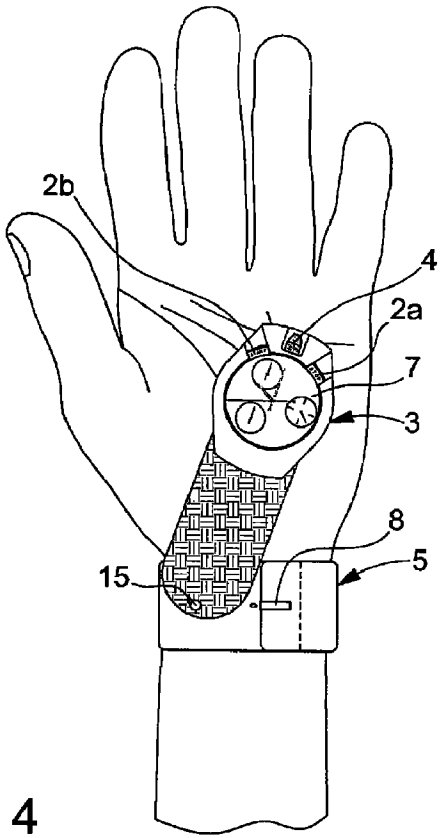
FIGS. 3 and 4 show the same wristwatch as that of FIGS. 1 and 2 in the position where it is unfolded into the hand, and in the flat opened out position.

Referring first of all to FIGS. 1 to 4, a first embodiment showing the basic principle of the invention will be described hereinafter, wherein case 3 can occupy a normal position while being held on the wrist by an encircling wristband 5 closed by a clasp 8 (FIG. 1) and a second position wherein it is unfolded outside wristband 5 so as to be able to be positioned in the hand (FIG. 3). Clasp 8 will be illustrated hereinafter by a simple buckle and tongue 8*a* secured to the end of strand 12 of wristband 10 located at 12 o'clock. It is clear that other types of clasps could be used.

Figure 4:
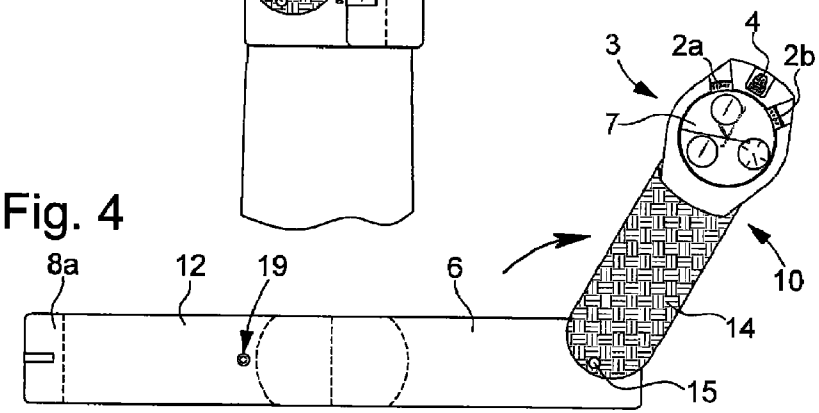

As can be seen more easily in FIG. 2, when clasp 8 is open and the wristwatch is placed flat on a table, case 3 is fixedly mounted at the end of an additional flexible strand 10 made in a single piece 14. The other end of strand 14 includes a pivoting point 15 on strand 6 of wristband 10 located at 6 o'clock. This pivoting point 15 can be achieved by any known means, for example by means of riveting with play. Part 14, forming additional strand 10, and thus also case 3, are held in the normal position (FIGS. 1 and 2) by locking/unlocking means 19 between strand 12 and additional strand 10, as can be seen in FIG. 4 showing the wristwatch unfolded flat. These locking/unlocking means can be of any known type, such as a pressure type device as shown, or a pusher-bolt device.

Figure 5:
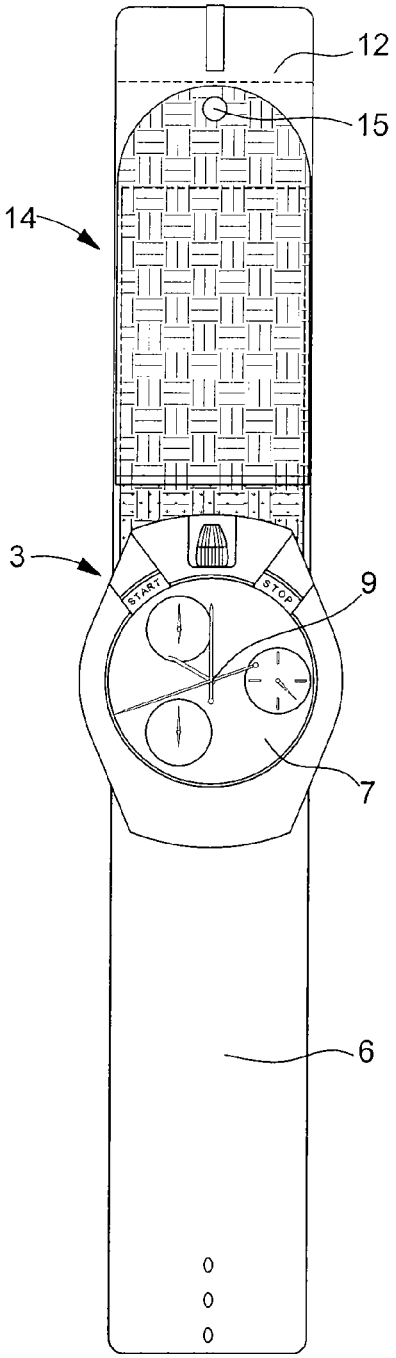
Figure 6:
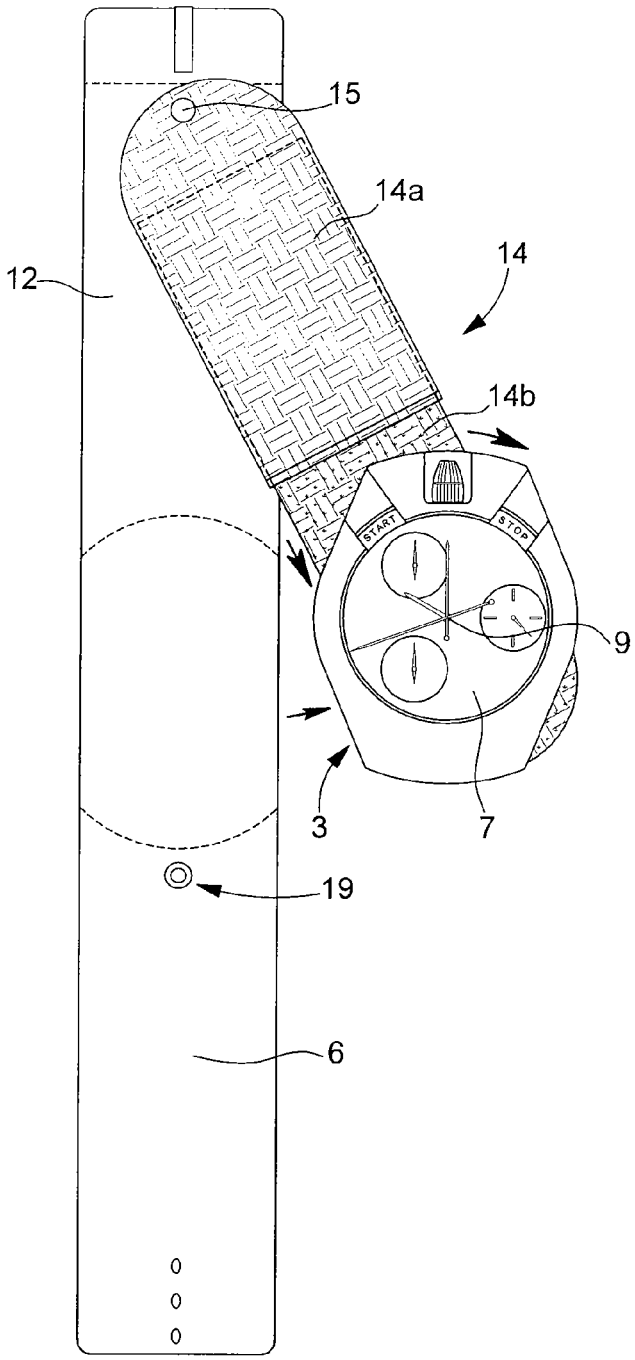

FIGS. 5 and 6 show in top views, with the wristwatch unfolded flat, a second embodiment, which differs from the preceding one in that the pivoting point 15 of additional strand 14 is positioned on 12 o'clock, strand 12 of wristband 5. When case 3 is unfolded, as shown in FIG. 6, it is clear that the display 7 will be turned over. Case 3 is therefore rotatably mounted on the end of additional strand 14 about a point of rotation 9. It is then possible to turn case 3 over through 180° in order to read display 7 normally when case 3 is positioned in the hand.

As in the first embodiment, additional strand 14 may be flexible, but not extendable lengthways. According to a variant that is also shown in FIGS. 5 and 6, additional strand 14 can also be extendable lengthways so as to allow the user to have better positioning in the palm of his hand, or in his fingers. In the example shown, additional strand 14 is formed by a hollow sheath 14*a* into which a tongue 14*b* can slide. Equally, but in a non-limiting manner, strand 14 could be formed of spring loaded links, or be made of an elastic material. This variant is evidently applicable to the first embodiment in addition to other embodiments that will now be described.

Figure 7:
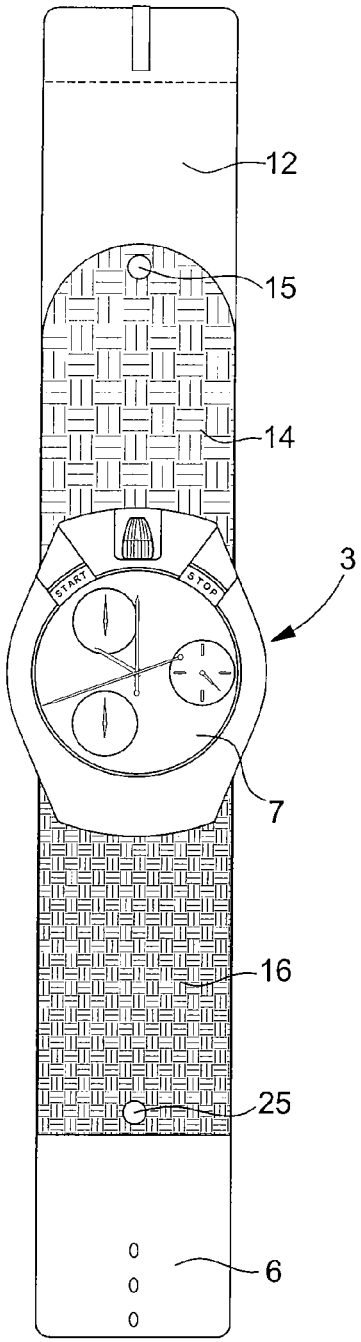
Figure 8:
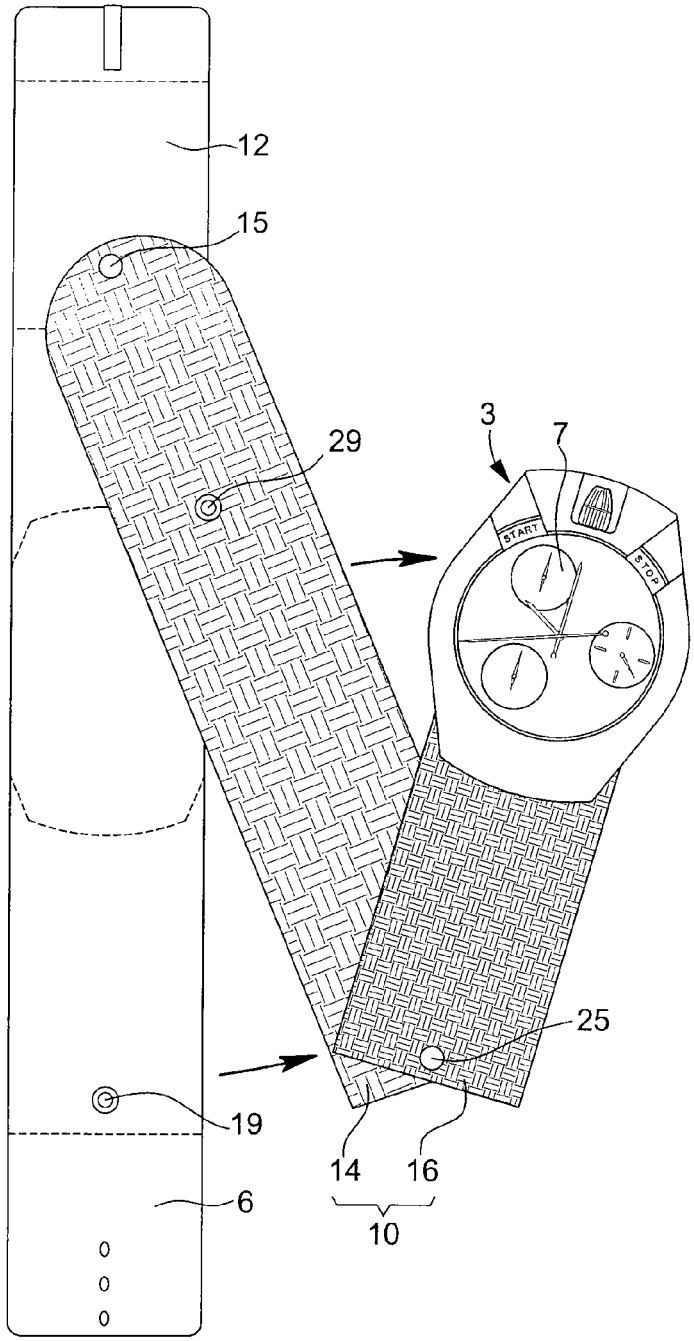

FIGS. 7 and 8 show in top views, with the wristwatch unfolded flat, a third embodiment that differs from the preceding ones in that the additional flexible strand 10 is made in two parts 14, 16, which are hinged to each other by a second pivoting point 25. The first part 14 includes at the end thereof the first pivoting point 15 on wristband 5, said pivoting occurring, in this embodiment, on the 12 o'clock strand 12.

The end of the second part 16 carries the fixedly mounted case 3. The dual pivoting case 3 means that its display 7 is in the usual reading position when case 3 is unfolded into the hand. When case 3 is in the normal position (FIG. 7) the first part 14 is held on wristband 5 as previously by a first locking/unlocking device 19 and the second part 16 by a second locking/unlocking device 29 provided between the end of second part 16 and first part 14. It will be observed that the first locking/unlocking device 19 can advantageously be associated with the second pivoting device 25, so as to reduce the number of parts to be assembled.

Likewise, by making one or other of parts 14, 16 of additional strand 10 extendable, the variant provided in the second embodiment would allow pivoting points 15, 25 to be brought closer to the centre of the wristband, if only for aesthetic purposes.

Figure 9:
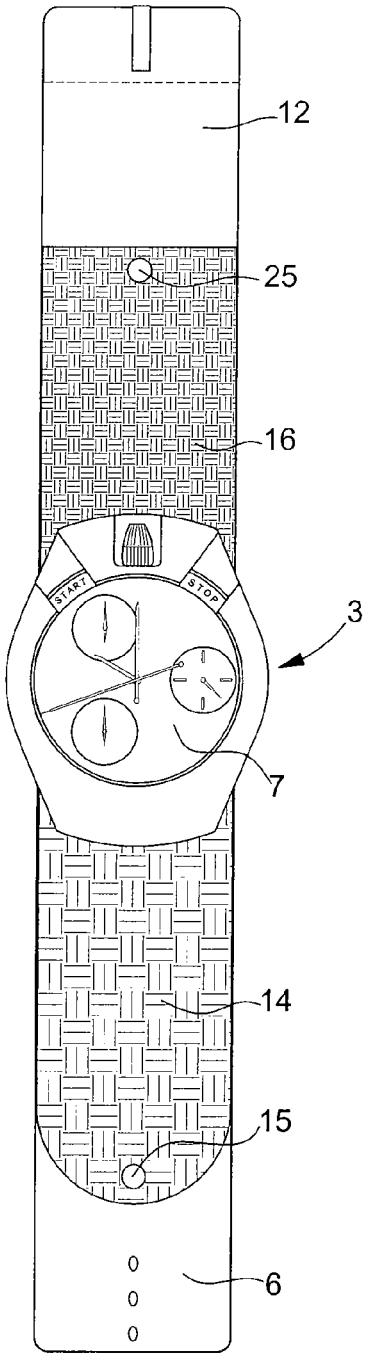
Figure 10:
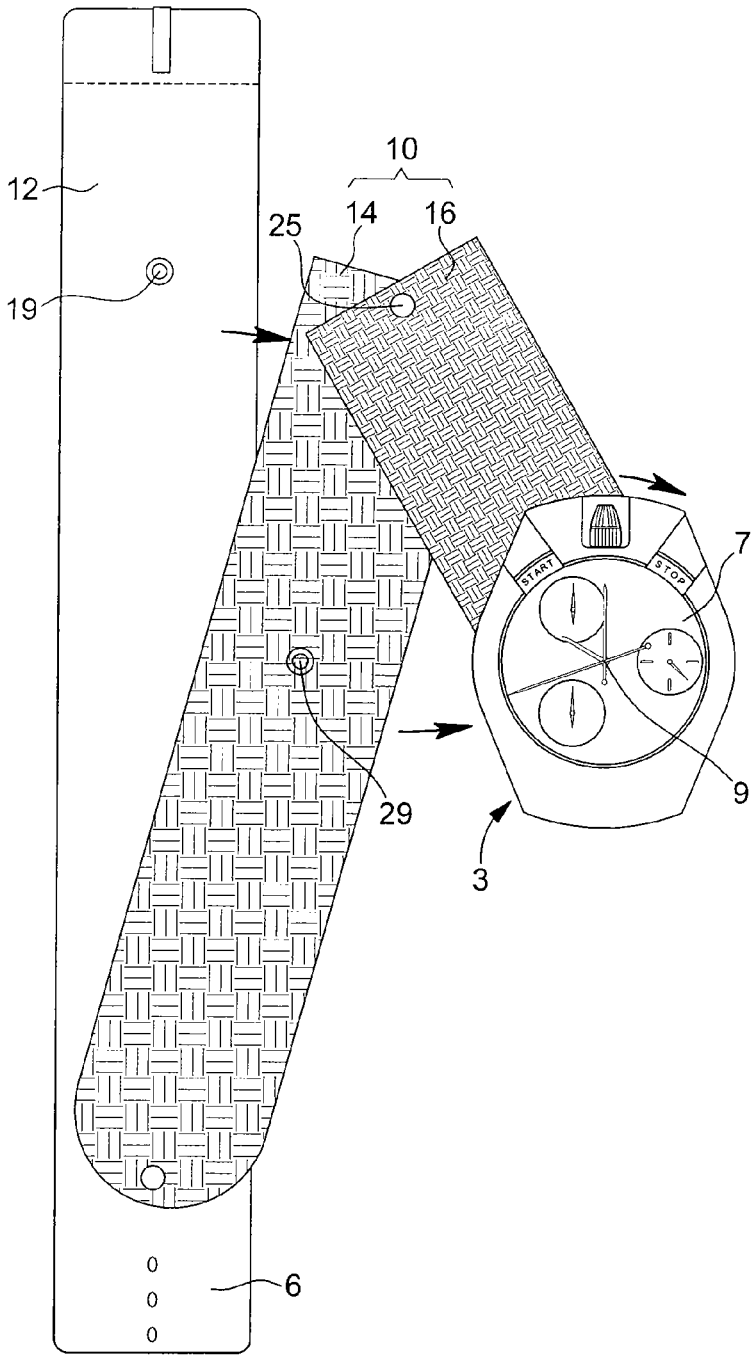

FIGS. 9 and 10 show a fourth embodiment, having all the features of the preceding embodiment, but which differs therefrom in that the first part 14 of additional strand 10 is pivotably mounted on the 6 o'clock strand 6 of wristband 5. As in the second embodiment, this assumes that case 3 can be reoriented by rotation about a rotation point 9. This embodiment will not therefore be described any further.

FIGS. 11 and 12 show a fifth embodiment, along the same principle as the third and fourth embodiments, but which differs therefrom in that the junction between parts 14, 16 of additional strand 10 is achieved by means of a hinge 22. In such conditions, after case 3 has been unfolded, the first display 7 is located opposite the palm of the hand and is not therefore visible. However, this embodiment allows a second display 7 to be provided in the back cover of case 3. In the example shown, this is a compass, but one could image any other type of display ranging from a simple vanity mirror to the keyboard of a calculator, telephone, diary etc. In this latter case, displays 7 and 17 should of course be read in reverse, or case 3 should be rotated, as in the second and fourth embodiments. It will be observed that the basic pivoting point 15 may be located on either of strands 6, 12 of wristband 5.

Figure 13:
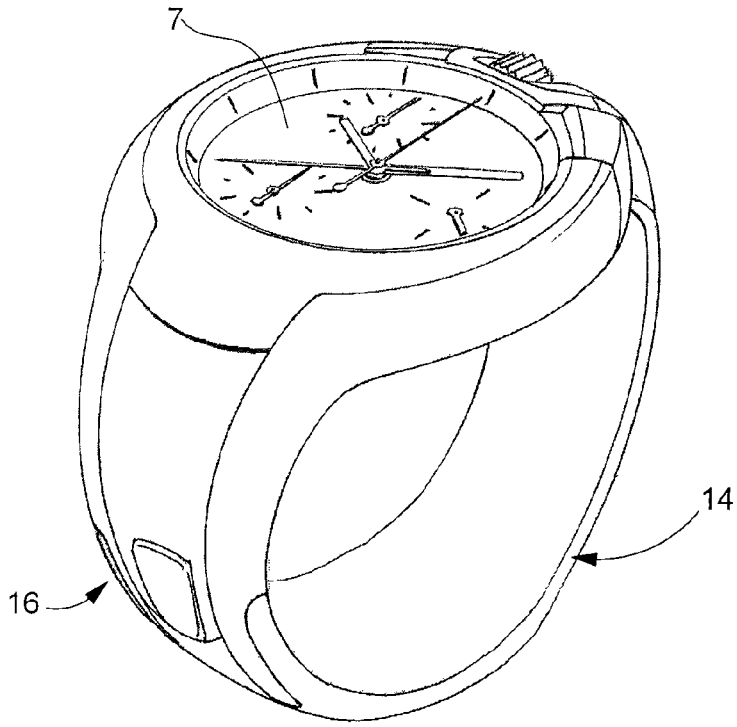
FIGS. 13 and 14 show perspective views of a sixth embodiment, respectively in the normal position and in the unfolded position.
Figure 14:
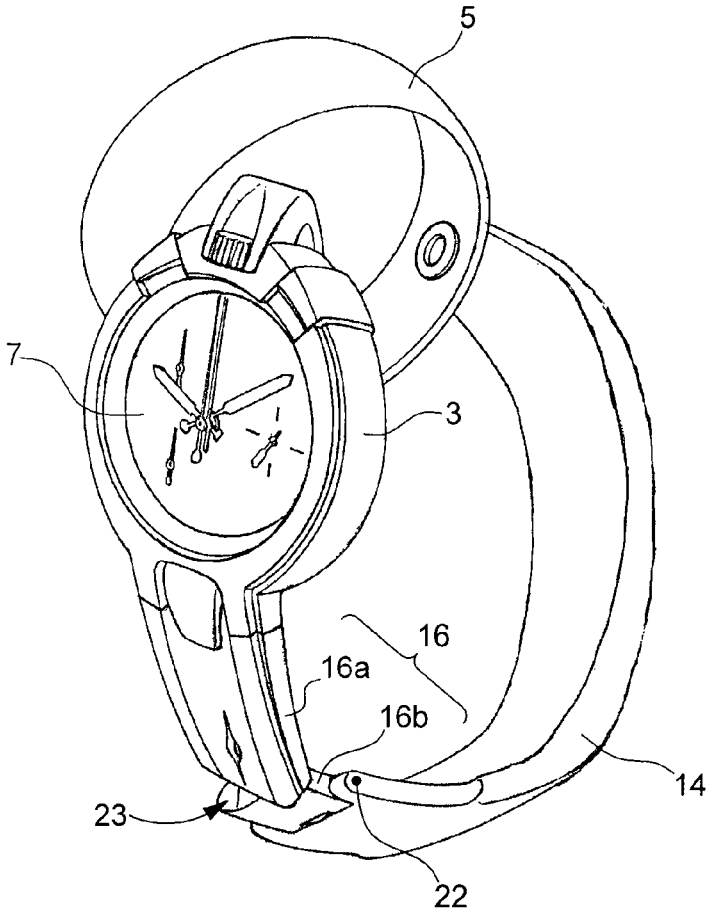

FIGS. 13 and 14 show in perspective a sixth embodiment which differs from the preceding one in that the junction between parts 14 and 16 of additional strand 10 is also achieved by means of a pivoting pin 23 along the length of second part 16, which is then formed of two disjoint parts 16*a*, 16*b*. Equally, this pivoting 24 could occur on the first part 14 of additional strand 10. This construction has the advantage of allowing either one of displays 7 and 17 to be read when the case is unfolded in the hand.

Figure 15:
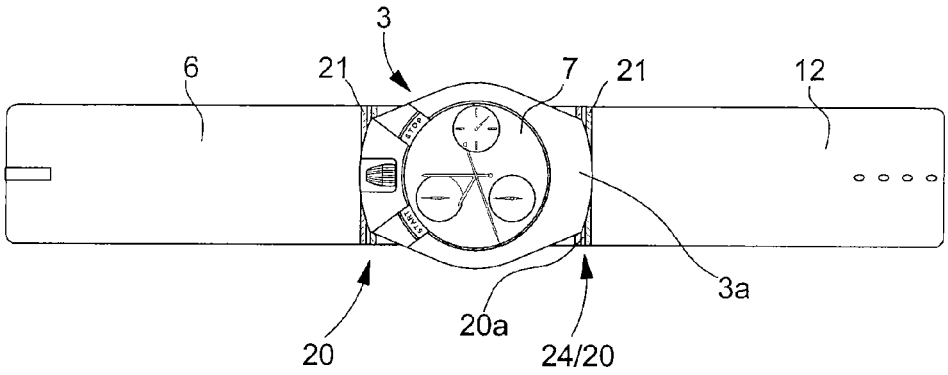
FIGS. 15 and 16 show a top view with the wristband opened out flat, a seventh embodiment respectively in the normal position and in the unfolded position.
Figure 16:
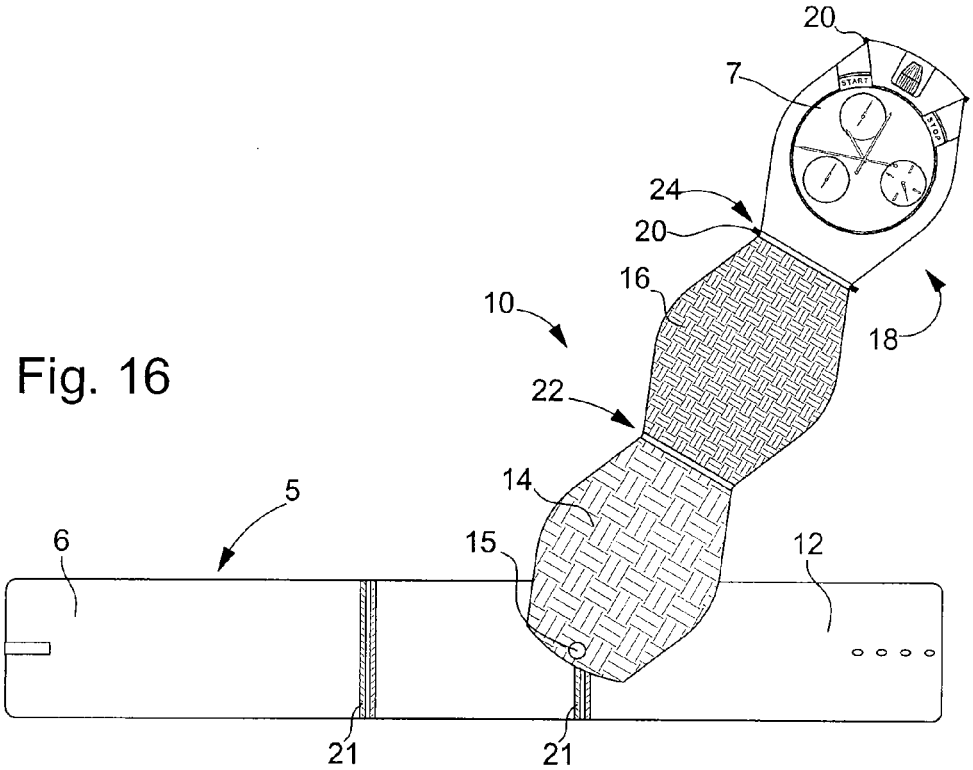

In the embodiments that have just been described, the additional flexible strand 10 is made in one or two parts 14, 16. FIGS. 15 and 16 show a seventh embodiment wherein the additional strand 10 is made in more than two parts, namely in this example, in three parts 14, 16 and 18. The first part 14 comprises, as in the preceding examples, a pivoting point 15 on wristband 5. The second part 16 comprises, as in the fifth embodiment, a hinge 22 for connecting the latter to first part 14. The third part 18 is connected to second part 16 by a second hinge 24 and supports case 3. These three parts 14, 16, 18 can be held in place in the normal position by three locking/unlocking means of the type of those previously described, with accordion type folding for concealing them, or almost, underneath case 3. When one wishes to place case 3 in the hand, the dual swivelling about hinges 22, 24 allows display 7 to take a usual reading position.

It will also be observed, according to the variant shown, that the third part 18 can be merged with case 3, hinge 24 then being formed by a bar 20 at position 6 of display 7.

Moreover, bar 20 or, as shown for improved comprehension portions 20*a* extending beyond horns 3*a* of case 3, can also form the locking/unlocking means by snapping into studs 21 secured to strand 6 of wristband 5. The same arrangement can be provided at 6 o'clock, such that the number of locking/unlocking means can be brought back to two.

Figure 17:
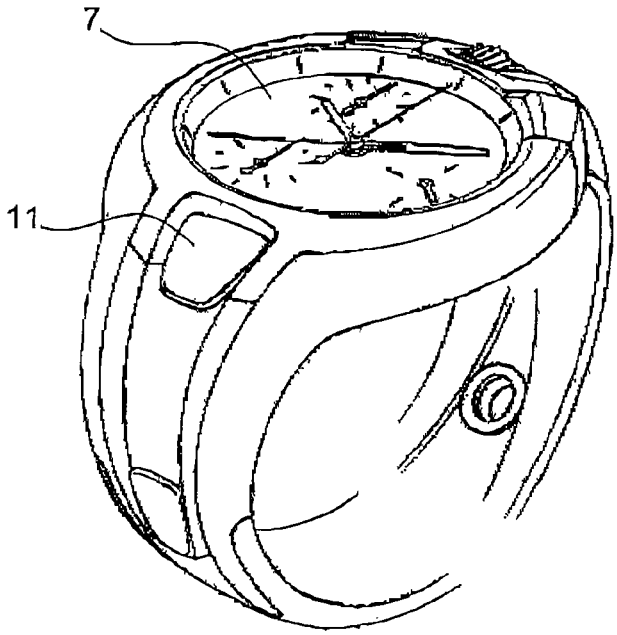
FIGS. 17 and 18 show perspective views of variants of the preceding embodiments, respectively in the normal position and in the semi-unfolded position.
Figure 18:
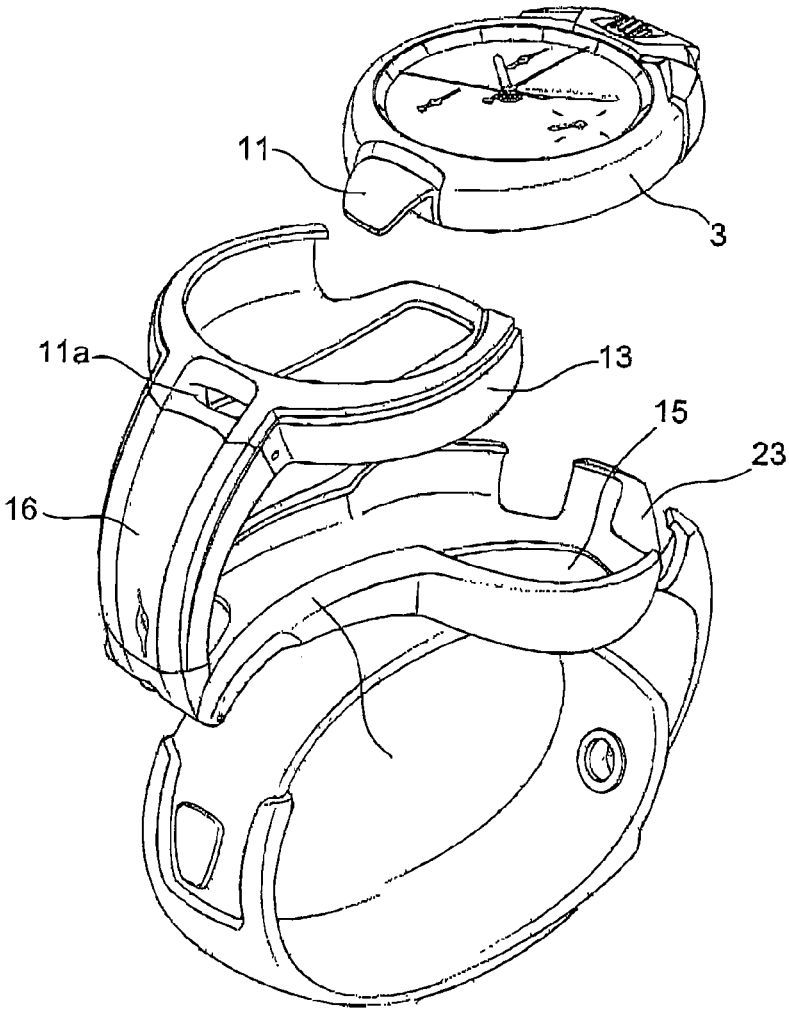

FIGS. 17 and 18 show, in a condensed way, variants applicable to the preceding embodiments. These Figures show the possibility of fitting case 3 into a rigid housing 13 provided at the end of additional strand 10 (in this case part 16) for example by means of an S shaped spring that fits into a slot 11*a* of said housing 13. This allows, for example, the chronograph to be detached from the wristband and secured to a link worn around the neck.

Likewise, rigid housing 13 or case 3 can be fitted into another rigid housing 23 secured to first part 14 when the additional strand 10 is in two parts, or directly to wristband 5 when additional strand 10 is in a single part. Rigid housing 23 can thus be substituted for one of the locking/unlocking means.

Of course, these variants could be combined or implemented separately, whatever the embodiment, and other embodiments could be envisaged by those skilled in the art without departing from the scope of the present invention.

What is claimed is:

1. A wristwatch comprising:

(a) an unfolding case, wherein the case includes at least one watch movement, at least one control member carrying out the at least one watch movement, and at least one display member arranged to display the current time and other time related information or the current time and non-time related information;

(b) a wristband or bracelet in a single piece, wherein the wristband is secured around a user's wrist by a clasp connecting ends of the wristband in a front of the user's wrist; and (c) an additional flexible strand, wherein one end of the additional flexible strand has a pivoting point on the wristband at which a pivoting occurs about an axis perpendicular to a plane of the wristband, and an other end of the additional flexible strand carries the case; and wherein the case of the flexible strand moves from the normal position on the back of the user's wrist where the case is locked by locking/unlocking means, to a second position positioned in the palm of the hand of the user after unlocking the locking/unlocking means, wherein when the case is positioned in the normal position, the at least one control member and the at least one display member of the case are disposed on the back of the user's wrist, and when the case is positioned in the second position, the at least one control member and the at least one display member of the case are disposed in the palm of the hand of the user.

2. The wristwatch according to claim 1, wherein the additional strand is in a single part and includes the pivoting point on the strand of the wristband located at 6 o'clock, the case being fixedly mounted on the other end of the part of the additional strand.

3. The wristwatch according to claim 1, wherein the additional strand is in a single part and includes the pivoting point on the strand of the wristband located at 12 o'clock, the case being rotatably mounted on the other end of the part of the additional strand, so as to be able to pivot 180°.

4. The wristwatch according to claim 1, wherein the additional flexible strand is made in two parts connected to each other by a second pivoting point about an axis perpendicular to the plane of the parts of the additional strand, the first part including at the end thereof the pivoting point on the wristband, and at the other end a first locking/unlocking means, and the second part carrying the case at the end thereof and a second locking/unlocking means.

5. The wristwatch according to claim 4, wherein the pivoting point on the wristband is located underneath the strand at 12 o'clock, the case being fixedly mounted on the end of the second part of the additional strand.

6. The wristwatch according to claim 4, wherein the pivoting point on the wristband is located on the strand at 6 o'clock, the case being rotatably mounted on the end of the second part of the additional strand.

7. The wristwatch according to claim 1, wherein the additional flexible strand is made in three parts, the first part comprising at the end thereof the pivoting point on the wristband, the second part being connected to the first part by a hinge and the third part being connected to the second part by a second hinge while carrying a fixed case.

8. The wristwatch according to claim 7, wherein the case includes bars, one of said bars being merged with the second hinge and forming a first locking/unlocking means by fitting into studs secured to the wristband, the other bar forming the second locking/unlocking means by fitting into other studs also secured to the wristband.

9. The wristwatch according to claim 1, wherein at least one of the parts of the additional flexible strand is also extendable lengthways.

10. The wristwatch according to claim 1, wherein the case is secured to a housing, which is itself secured to the additional strand.

11. The wristwatch according to claim 10, wherein the case can be separated from the housing.

12. The wristwatch according to claim 1, wherein the at least one control member drives a chronograph mechanism.

13. The wristwatch according to claim 12, wherein the at least one control member is positioned at 12 o'clock.

14. A wristwatch comprising an unfolding case including:

(i) a wristband or bracelet in a single piece, wherein the wristband is secured around the user's wrist by a clasp connecting ends of the wristband in a front of the user's wrist, when the case is disposed in a normal position on a back of the user's wrist, and wherein said case carries at least one watch movement, and at least one display able to display the current time and to display other time related or non-time related information; and (ii) an additional flexible strand, wherein one end of the additional flexible strand has a pivoting point on the wristband, wherein said pivoting occurs about an axis perpendicular to a plane of the wristband, and wherein an other end of the additional flexible strand carries the case, the flexible strand moves from the normal position on the back of the user's wrist where the case is locked by locking/unlocking means, to a second position positioned in the hand of the user after unlocking the locking/unlocking means, wherein the additional flexible strand is made in two parts connected to each other by a hinge, the first part including at the end thereof the pivoting point on the wristband and the second part carrying at the end thereof a fixed case having a first display of at least the current time in the normal position, and on the opposite face thereof a second display of another time related or non-time related piece of information.

15. The wristwatch according to claim 14, wherein the second display corresponds to a telephone function.

16. The wristwatch according to claim 14, wherein the junction between the two parts of the additional strand further includes a pivoting pin along the length of said additional strand.

17. The wristwatch according to claim 16, wherein the second display corresponds to a telephone function.

18. The wristwatch according to claim 16, wherein the case is also rotatably mounted on the end part of the additional strand.

19. The wristwatch according to claim 14, wherein the case is also rotatably mounted on the end part of the additional strand.

20. The wristwatch according to claim 19, wherein the second display corresponds to a telephone function.

* * * * *